United States Patent [19]

Harris

[11] Patent Number: 4,499,741

[45] Date of Patent: Feb. 19, 1985

[54] STRETCHABLE KNITTED ARTICLE WITH PRINTED DESIGN

[75] Inventor: Ronald R. Harris, Lincolnton, N.C.

[73] Assignee: Kemfast Textiles, Inc., Granite Falls, N.C.

[21] Appl. No.: 379,642

[22] Filed: May 19, 1982

[51] Int. Cl.[3] ..... D04B 1/02

[52] U.S. Cl. ..... 66/171; 66/194; 2/170; 2/162; 2/181; 2/DIG. 11

[58] Field of Search ..... 66/169, 170, 171, 185, 66/194; 2/162, 170, 181, DIG. 11

[56] References Cited

U.S. PATENT DOCUMENTS

| | | | |
|---|---|---|---|
| 2,144,563 | 1/1939 | Pauls | 66/185 X |
| 4,047,400 | 9/1977 | Thorneburg | 66/171 |
| 4,255,949 | 3/1981 | Thorneburg | 66/185 |
| 4,277,959 | 7/1981 | Thorneburg | 66/187 |
| 4,373,361 | 2/1983 | Thorneburg | 66/178 R |

*Primary Examiner*—Ronald Feldbaum

*Attorney, Agent, or Firm*—Richards, Shefte & Pinckney

[57] ABSTRACT

A stretchable knitted article of predominately terry loop construction, e.g., an athletic headband, with a design printed thereon, includes a knitted fabric of single jersey construction the reverse side of which has a predominant terry loop region bordering an integrally knit smaller reverse-side plain jersey region. The plain jersey region is oriented in the article for coursewise stretching such that the sinker loop and needle loop crests of the yarn thereof are substantially the only visible yarn portions in both the stretched and unstretched conditions of the article. The design is printed on the plain region whereby it maintains its definition and continuity of appearance when stretched in ordinary use.

4 Claims, 17 Drawing Figures

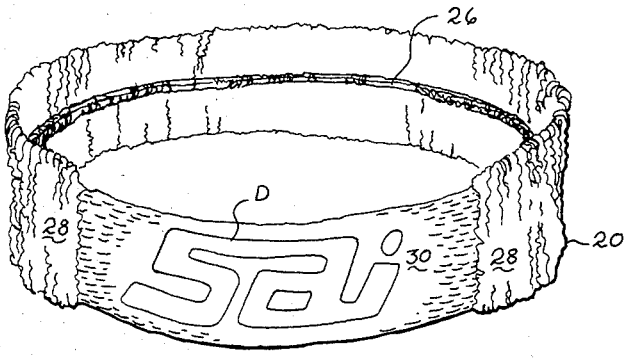
Fig. 1
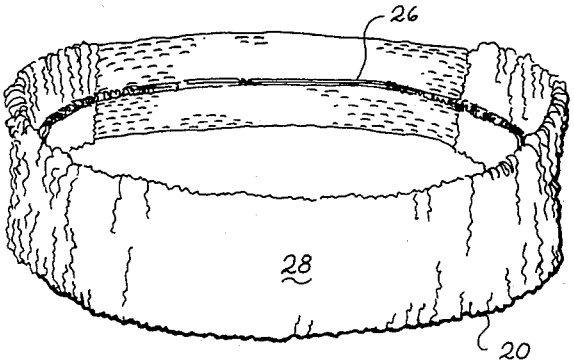
Fig. 2
Fig. 3
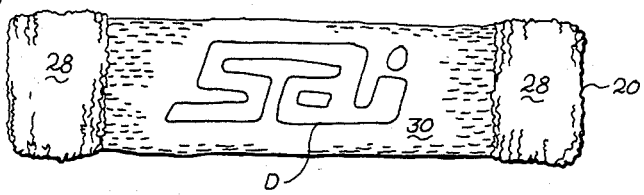
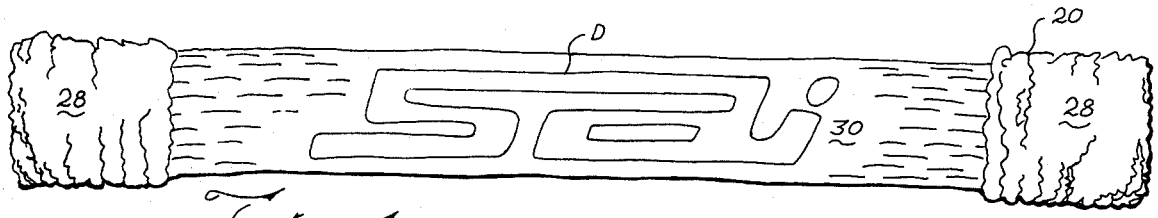
Fig. 4
Fig. 5
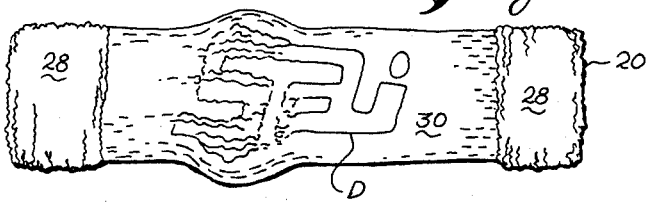

Fig. 6
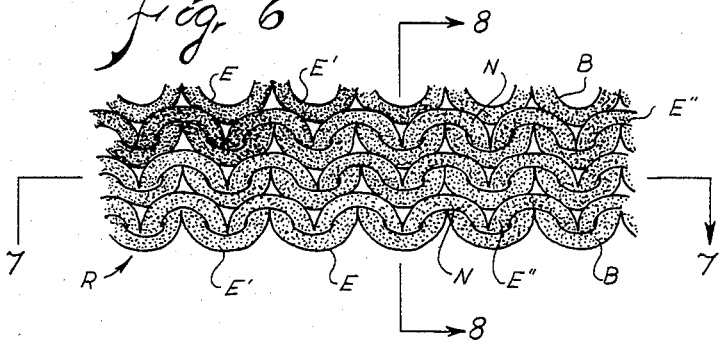
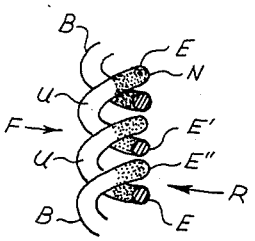
Fig. 8
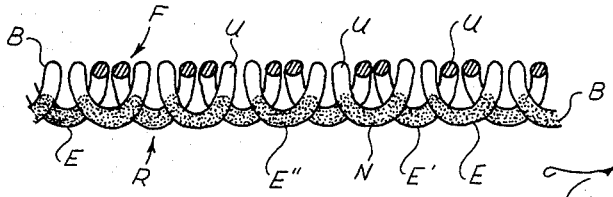
Fig. 7
Fig. 9
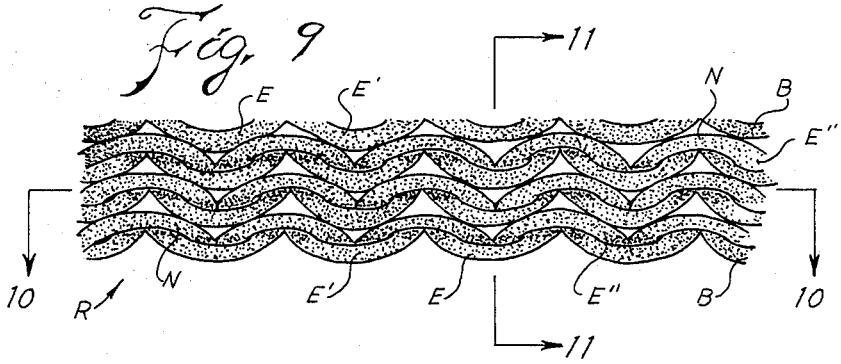
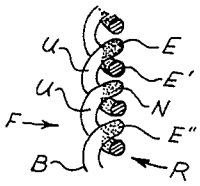
Fig. 11
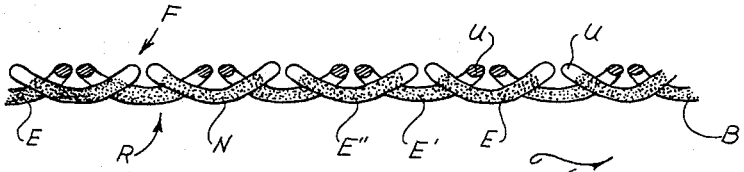
Fig. 10
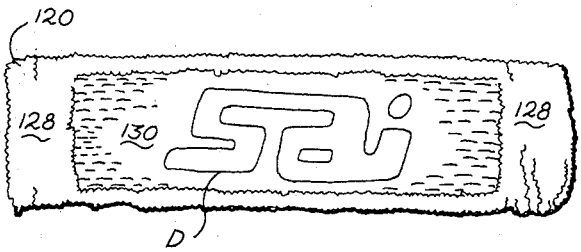
Fig. 17

Fig. 12
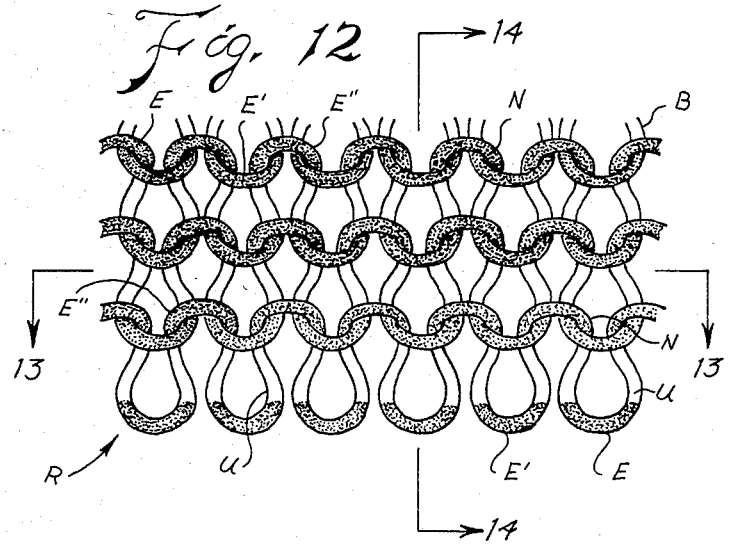
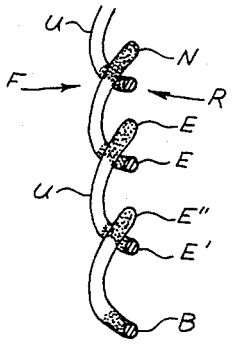
Fig. 14
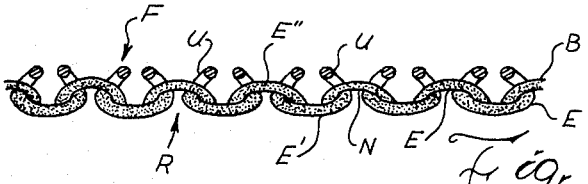
Fig. 13
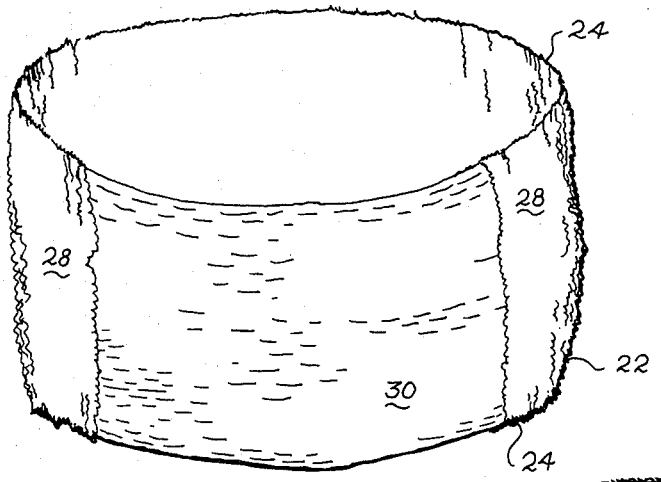
Fig. 15
Fig. 16
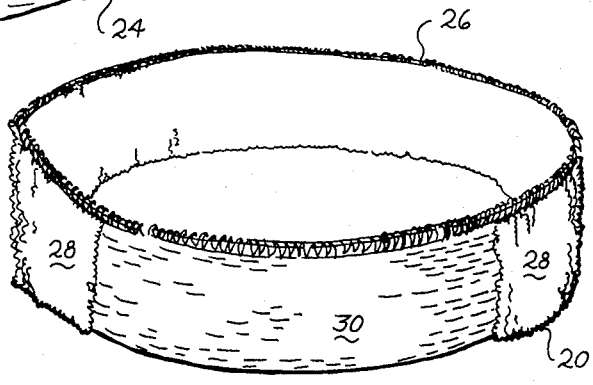

STRETCHABLE KNITTED ARTICLE WITH PRINTED DESIGN

BACKGROUND OF THE INVENTION

The present invention relates generally to stretchable knitted articles and particularly to such articles having a terry loop construction and to the printing of designs thereon.

The printing of designs on stretchable knitted textile fabrics and articles formed therewith is conventionally considered to be undesirable in that the desired design must ordinarily be printed on the fabric in its unstretched condition and will not retain its definition and continuity of appearance when stretched in ordinary use. This problem is especiallly acute if the fabric to be printed is of a terry loop construction, since it is difficult to apply a clearly defined printed design to this type of fabric even when unstretched. Accordingly, it is conventional wisdom in the knitted textile printing art that designs in stretchable knits, particularly terry knits, must be achieved by techniques other than printing, such as other fabric dyeing processes or by pattern knitting using differently colored yarns, all of which are significantly more expensive than printing. Thus, traditionally, only the costlier stretchable knit fabrics and articles produced therefrom which justify such more expensive techniques have been manufactured in patterns or designs, with other stretchable knit fabrics and articles usually being manufactured only in solid colors.

In contrast, the present invention provides a stretchable knitted article of wearing apparel of a particular combination and arrangement of terry knit and plain knit regions which facilitate the inexpensive printing of designs on the plain knit region which designs will maintain their definition and continuity of appearance in both the stretched and unstretched conditions of the article.

SUMMARY OF THE INVENTION

The stretchable knitted article of wearing apparel of the present invention includes a knitted fabric having yarn formed in loops extending in courses and wales on the outward surface of the fabric, a predominant region of the outward fabric surface being formed with terry knit loops and the terry knit region being integrally knit with a smaller plain knit region. The plain knit region is of a reverse-side single jersey loop construction arranged for coursewise stretching in ordinary use of the article such that the portions of the yarn of the plain knit region which are outwardly visible in the unstretched condition of the article are substantially the only portions of the yarn of the plain knit region which are outwardly visible in the coursewise stretched condition of the article. A design is printed on the outwardly visible portions of the yarn of the plain knit region and, thus, the design maintains its definition and continuity of appearance in both the unstretched and the stretched conditions.

In the preferred embodiment, the article of wearing apparel is an athletic article of typical terry construction, such as an athletic headband, wristband or sock. The article is of a circular knit construction, each course having a predominant number of wales formed of terry loop, single jersey construction and the remaining wales formed of the reverse-side single jersey loop construction, which remaining wales form the plain knit portion. The plain knit region is preferably only slightly greater in area than the design.

BRIEF DESCRIPTION OF THE DRAWINGS

FIG. 1 is a front perspective view of a knitted athletic headband incorporating the preferred embodiment of the present invention, shown in the unstretched condition thereof;

FIG. 2 is a rear perspective view of the unstretched headband of FIG. 1;

FIG. 3 is a front elevational view of the unstretched headband of FIG. 1;

FIG. 4 is another front elevational view of the headband of FIG. 1 shown in its coursewise stretched condition;

FIG. 5 is another front elevational view of the headband of FIG. 1 shown in a walewise stretched condition;

FIG. 6 is a diagrammatic view in front elevation of a portion of the printed design of the plain knit region of the headband of FIG. 1, shown in its unstretched condition;

FIG. 7 is a diagrammatic horizontal sectional view taken along line 7—7 of FIG. 6;

FIG. 8 is a diagrammatic vertical sectional view taken along line 8—8 of FIG. 6;

FIG. 9 is another diagrammatic view in front elevation of the outward surface of the portion of the printed design of the plain knit region of FIG. 6, shown in its coursewise stretched condition;

FIG. 10 is a diagrammatic horizontal sectional view taken along line 10—10 of FIG. 9;

FIG. 11 is a diagrammatic vertical sectional view taken along line 11—11 of FIG. 9;

FIG. 12 is another diagrammatic view in front elevation of the outward surface of the portion of the printed design of the plain knit region of FIG. 6, shown in its walewise stretched condition;

FIG. 13 is a diagrammatic horizontal sectional view taken along line 13—13 of FIG. 12;

FIG. 14 is a diagrammatic vertical sectional view taken along line 14—14 of FIG. 12;

FIG. 15 is a perspective view of the circularly knitted fabric of the headband of FIG. 1 prior to the sewing and printing thereof to produce the headband article as shown in FIG. 1;

FIG. 16 is a perspective view of the knitted fabric of FIG. 16 axially folded upon itself with the ends thereof sewn together to produce the headband of FIG. 1; and FIG. 17 is a perspective view of another embodiment of a knitted athletic headband incorporating the preferred embodiment of the present invention.

DESCRIPTION OF THE PREFERRED EMBODIMENT

Referring now to the accompanying drawings, the present invention is shown as preferably embodied in a stretchable knitted athletic headband 20 (FIGS. 1 and 2). However, as will be appreciated by those skilled in the art and will be more fully understood from the following disclosure, the present invention is of a broad utility and applicability and may be equally well embodied in a wide variety of other stretchable knitted articles, such as athletic wristbands, socks, hatbands, golf club head covers and many other like items, without departing from the substance and scope of the present invention. It is to be understood that the present invention is not limited by the following description of its preferred embodiment in the athletic headband 20, such description being made solely for the purpose of providing a sufficiently complete and enabling exemplary disclosure of the invention to the skill of the art.

The headband 20 is produced from a length of tubular circularly-knitted stretchable fabric 22 (FIG. 15) by folding the fabric 22 axially upon itself and sewing together the ends 24 thereof to form a seam 26 (FIG. 16) which is ordinarily disposed inwardly in the normal wearing of the headband 20 (FIGS. 1 and 2). The knitted fabric 22 of the headband 20 is formed in conventional manner using a conventional circular knitting machine, of yarn circularly knit in needle and sinker loops of single jersey construction extending in circumferential courses and axial wales to form on the reverse side of the fabric 22 a predominant region 28 of terry knit construction integrally knit with a smaller region 30 of plain, reverse-side single jersey construction. Specifically, each course of the fabric 22 has a resiliently stretchable base yarn B (FIGS. 6–14) of the conventional type having a spandex elastic core wrapped by cotton fibers, knit in every wale in single jersey needle loops and has a terry yarn (not shown) knit in single jersey needle loops in plated relationship with the base yarn B in a predominant number of predetermined consecutive wales and forming terry pile loops extending outwardly between such wales on the reverse side R of the fabric 22 and, in this manner, the predominant consecutive wales form the aforesaid terry region 28 and the remaining wales form the aforesaid plain region 30. It is to be noted that the described individual constructions of the respective terry and plain regions 28, 30 are conventional and, accordingly, the particular construction of the terry region 28 is not shown except representatively in FIGS. 1–5, 15 and 16 and the construction of the plain region 30 is shown only diagrammatically, as more fully described hereinafter, in FIGS. 6–14. As will be understood, the described circular fabric 22, when produced on a conventional circular knitting machine, will be oriented upon leaving the machine with the reverse side of the fabric 22 facing radially inwardly. Accordingly, the desired length of the fabric 22 is first inverted inside out to the orientation of FIG. 15 to dispose the terry and plain portions 28, 30 of the fabric's reverse side R on the outward surface of the fabric 22 and is then folded axially inwardly upon itself and sewn as previously described, whereby the predominant terry region 28 and the plain region 30 comprise the entire outwardly exposed surface area of the headband 20.

It will therefore be seen that the plain knit region 30 is oriented in the headband 20 for coursewise, but not walewise, stretching in the ordinary use of the headband 20, this being an important feature of the present invention, as will presently be explained. Th plain knit region 30 by its reverse side single jersey loop construction provides a relatively smooth surface on which may be printed by any conventional manner, e.g. screen-printing, a design or any other desired decoration; for instance, the "Sai" logo indicated at D in FIGS. 1–5, which is a registered trademark used by the assignee hereof. According to conventional practices, the plain knit region 30 will be so printed when in its unstretched condition and, therefore, only the portions of the base yarn B actually exposed on the outward, reverse-side jersey surface of the plain knit region 30 will receive the printing of the logo design D. More specifically, the appearance of the unstretched reverse-side jersey construction of the plain knit region 30 created by such outwardly-exposed base yarn portions thereof, designated at E, is diagrammatically illustrated in substantial enlargement in FIG. 6 with the exposed base yarn portions E shown darkened as representative of having received printing. As will be seen and understood, the single jersey construction of the fabric 22 and the resilient, elastic nature of the base yarn B result in the needle loops N of the base yarn B being curved between the reverse side R and face side F of the fabric 22 in its unstretched condition (See FIGS. 7 and 8), whereby substantially only the sinker loops E′ and the crests E″ of the needle loops N of the base yarn B are exposed outwardly on the plain region 30 of the reverse side of the fabric 22 with the remaining portions of the base yarn B in the plain region 30, i.e. the walewise-extending side lengths of the needle loops indicated at U, being unexposed. Accordingly, the sinker loops E′ and the needle loop crests E″, but not the unexposed needle loop portions U, of the base yarn B in the plain region 30 receive the printing of the logo design D and, as can be seen, the printing appears outwardly as continuous and uninterrupted and therefore creates a well-defined design in the unstretched condition of the headband 20.

In the ordinary coursewise stretching of the headband 20, it will be understood that the relative orientation and disposition of the exposed and unexposed base yarn portions E, U are deformed from the unstretched condition thereof shown in FIGS. 6–8, as is diagrammatcially illustrated in FIGS. 9–11. Specifically, under conditions of ordinary coursewise stretching of the headbank 20, the coursewise oriented and extending portions of the base yarn B, i.e., the sinker loops E′ and the needle loop crests E″, elongate and stretch from their ordinary curved, relaxed disposition (FIGS. 6–8) to a substantially more linear disposition, which causes such base yarn portions E′,E″ to be drawn more together walewise, the walewise oriented extending portions of the base yarn B, i.e. the unexposed base yarn needle loop side lengths U, thereby being separated walewise, and being partially drawn coursewise by the coursewise portions E′,E″, but otherwise being relatively unstretched and remaining unexposed to the outward surface of the plain portion 30. Thus, it will be seen that in the coursewise stretched condition of the headband 20, the outwardly exposed base yarn portions E′,E″ of the plain region 30, although stretched coursewise, still constitute substantially the entire outwardly visible base yarn portions of the plain region 30 and, accordingly, the printed design D carried thereby is generally symmetrically elongated sidewise and retains its definition and continuity of appearance, as illustrated in FIG. 4.

In contrast, the deformation of the exposed and unexposed base yarn portions E,U of the plain region 30, which would occur under any condition causing walewise stretching of the handband 20 would create substantial distortion of the printed design D, as shown diagrammatically in FIGS. 12–14. Specifically, when the plain region 30 of the headband 20 is stretched walewise, the curved, walewise-extending base yarn needle loop side lengths U are elongated and stretched from their ordinary relaxed disposition (FIGS. 6–8) into a substantially more linear disposition which causes the coursewise-extending sinker loops E′ and the needle loop crests E″ to be separated walewise and thereby exposes outwardly the needle loop portions U. As will be understood, therefore, such walewise stretching of the plain region 30 causes the printed design D to appear discontinuous, fragmented and interrupted by the thusly exposed unprinted base yarn portions U, whereby the design D substantially loses its definition, as illustrated in FIG. 5.

It will therefore be seen that the present invention uniquely provides a stretchable knitted article of predominately terry knit construction which facilitates the printing of any desired design thereon by providing a relatively small non-terry region for receiving the printed design and further advantageously prevents distortion of the printed design in ordinary stretching of the article in use by providing the non-terry region with a reverse side single jersey loop construction and orienting such non-terry region in the article for coursewise stretching in its ordinary use. In this manner, stretchable knitting articles which traditionally have been constructed predominately or entirely of terry knit fabric and which conventionally have not been susceptible to printed decoration, may now be inexpensively provided with a printed design or the like while retaining the articles' desired terry knit nature. Such items includes, for example, athletic headbands as above described, wristbands, socks, golf club head covers and a variety of other similar articles. All of these particular items will be recognized to be athletically-oriented and, accordingly, the improved feature thereof provided by the present invention for carrying a logo design or the like will readily facilitate their use as a merchandising tool in displaying and advertising the brand name of various well-known athletic goods. Of course, innumerable other possibilities for equally advantageous use of the present invention will be understood to also exist.

It the preferred embodiment described above, the plain knit region 30 extends the entire walewise extent of the fabric 22 constituting the headband 20. It will be understood, however, that, depending upon the particular article and design involved, it is ordinarily only necessary that the plain knit region 30 be sufficiently larger in walewise and coursewise extent to accomodate the desired design D. In FIG. 17, for instance, another embodiment of the present invention in a headband 120 is shown wherein the plain knit region 130 thereof is of a walewise extent only slightly greater than the size of the design D with the predominant terry region 128 thereof bordering the plain region 130 on both its coursewise and walewise sides. The manner in which the fabric for such a headband 120 may be knitted is conventional and forms no part of the present invention and, accordingly, is not herein described.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. A stretchable knitted article comprising a knitted fabric including yarn formed in loops extending in courses and wales on the outward surface of said fabric, a predominant region of said outward surface being formed with terry knit loops and said terry knit region being integrally knit with a smaller plain knit region of said outward surface, said plain knit region being of a reverse-side single jersey loop construction arranged for coursewise stretching in ordinary use of said article such that the portions of said yarn of said plain knit region which are outwardly visible in the unstretched condition of said article are substantially the only portions of said yarn of said plain knit region which are outwardly visible in the coursewise stretched condition of said article, and a design printed on said outwardly visible portions of said yarn of said plain knit region, whereby said design maintains its definition and continuity of appearance in both said unstretched and stretched conditions of said article.

2. A stretchable knitted article according to claim 1 and characterized further in that said article is an athletic headband of circular knit construction each course of which has a predominant number of wales formed of terry-loop, single jersey loop construction, said remaining wales of said courses forming said plain knit portion.

3. A stretchable knitted article according to claim 1 and characterized further in that said plain knit region is of an area only slightly greater than said design.

4. A stretchable knitted athletic headband comprising a tubular circularly-knitted fabric including yarn formed in loops extending in circumferential courses and axial wales on the radially outward surface of said fabric for coursewise stretching in ordinary use of said headband, a predominant circumferentially-extending region of said outward surface being formed with terry knit loops and said terry knit region being integrally knit with a smaller plain knit region extending circumferentially intermediately of said terry knit region, said plain knit region being of a reverse-side single jersey loop construction such that the portions of said yarn of said plain knit region which are outwardly visible in the unstretched condition of said article are substantially the only portions of said yarn of said plain knit region which are outwardly visible in the coursewise stretched condition of said article, and a design printed on said outwardly visible portions of said yarn of said plain knit region, whereby said design maintains its definition and continuity of appearance in both said unstretched and stretched conditions of said article.

* * * * *